US005704330A

United States Patent [19]

Tsuchida

[11] Patent Number: 5,704,330

[45] Date of Patent: Jan. 6, 1998

[54] CYLINDER HEAD ARRANGEMENT FOR INTERNAL COMBUSTION ENGINE

[75] Inventor: Naoki Tsuchida, Iwta, Japan

[73] Assignee: Yamaha Hatsudoki Kabushiki Kaisha, Iwata, Japan

[21] Appl. No.: 651,505

[22] Filed: May 22, 1996

Related U.S. Application Data

[63] Continuation of Ser. No. 260,339, Jun. 15, 1994, abandoned.

[51] Int. Cl.[6] ..... F02B 15/00

[52] U.S. Cl. ..... 123/193.5

[58] Field of Search ..... 123/193.5, 193.3, 123/90.27, 90.33, 90.34, 196 R

[56] References Cited

U.S. PATENT DOCUMENTS

| | | | |
|---|---|---|---|
| 1,727,265 | 3/1929 | Aseltine . | |
| 3,318,292 | 5/1967 | Hideg . | |
| 3,408,992 | 11/1968 | Seggern et al. . | |
| 4,105,577 | 8/1978 | Yamashita . | |
| 4,174,686 | 11/1979 | Shimizu et al. . | |
| 4,228,772 | 10/1980 | Bakonyi . | |
| 4,240,387 | 12/1980 | Motosugi et al. . | |
| 4,256,062 | 3/1981 | Schafer . | |
| 4,269,153 | 5/1981 | Kunii et al. . | |
| 4,308,830 | 1/1982 | Yamada et al. . | |
| 4,320,725 | 3/1982 | Rychlik et al. . | |
| 4,371,438 | 2/1983 | Yagi et al. . | |
| 4,413,598 | 11/1983 | Tsutsumi . | |
| 4,428,334 | 1/1984 | Klomp . | |
| 4,452,218 | 6/1984 | Yokoyama et al. . | |
| 4,499,868 | 2/1985 | Kanda et al. . | |
| 4,537,166 | 8/1985 | Kimura et al. | 123/90.27 |
| 4,543,931 | 10/1985 | Hitomi et al. . | |
| 4,658,780 | 4/1987 | Hosoi . | |
| 4,660,529 | 4/1987 | Yoshikawa . | |
| 4,663,938 | 5/1987 | Colgate . | |
| 4,669,434 | 6/1987 | Okumura et al. . | |
| 4,700,669 | 10/1987 | Sakurai et al. . | |
| 4,719,886 | 1/1988 | Kotani et al. . | |
| 4,753,200 | 6/1988 | Kawamura et al. . | |
| 4,762,102 | 8/1988 | Kanda . | |
| 4,779,594 | 10/1988 | Oda et al. . | |
| 4,823,747 | 4/1989 | Wagner et al. | 123/90.27 |
| 4,826,561 | 5/1989 | Tsutsumi . | |
| 4,827,883 | 5/1989 | Khalighi et al. . | |
| 4,834,035 | 5/1989 | Shimada et al. . | |
| 4,974,566 | 12/1990 | LoRusso et al. . | |
| 4,995,359 | 2/1991 | Yokoyama et al. . | |

(List continued on next page.)

FOREIGN PATENT DOCUMENTS

| | | |
|---|---|---|
| 0054964 | 6/1982 | European Pat. Off. . |
| 0068481 | 1/1983 | European Pat. Off. . |
| 0074202 | 3/1983 | European Pat. Off. . |
| 0076632 | 4/1983 | European Pat. Off. . |

(List continued on next page.)

OTHER PUBLICATIONS

European Search Report dated Mar. 14, 1996.

European Search Report dated Oct. 5, 1992 w/ Patent Abstract.

European Search Report dated Nov. 23, 1992 w/Patent Abstract.

*Primary Examiner*—Marguerite McMahon

*Attorney, Agent, or Firm*—Knobbe, Martens, Olson & Bear LLP

[57] ABSTRACT

Two embodiments of cylinder head assemblies for multiple valve, multiple cylinder internal combustion engines wherein the poppet valves associated with each cylinder are disposed at an angle to each other. A cam carrier and tappet bearing member is affixed to the cylinder head by means of a lower surface that is parallel to a machine surface of the cylinder head that is perpendicular to the reciprocal axes of one of the poppet valves for each cylinder. A unitary bearing cap is affixed to this cam carrier for journaling the cam shaft. This bearing cap member is provided with a lubricant gallery and delivery system for supplying lubricant to the cam shaft bearing surfaces, cam lobes and tappets.

19 Claims, 10 Drawing Sheets

U.S. PATENT DOCUMENTS

| | | | |
|---|---|---|---|
| 4,998,518 | 3/1991 | Mitsumoto . | |
| 5,050,544 | 9/1991 | Tanaka et al. | 123/193.5 |
| 5,080,057 | 1/1992 | Batzill et al. | 123/193.5 |
| 5,121,718 | 6/1992 | Saito | 123/90.27 |
| 5,150,675 | 9/1992 | Murata | 123/193.5 |
| 5,207,197 | 5/1993 | Klingmann et al. | 123/90.27 |
| 5,213,071 | 5/1993 | Iwata et al. | 123/90.27 |

FOREIGN PATENT DOCUMENTS

| | | |
|---|---|---|
| 117850 | 9/1984 | European Pat. Off. . |
| 408081 | 4/1987 | European Pat. Off. . |
| 0221312 | 5/1987 | European Pat. Off. . |
| 0235288 | 9/1987 | European Pat. Off. . |
| 462568 | 12/1991 | European Pat. Off. . |
| 2569227 | 8/1986 | France . |
| 2709519 | 9/1977 | Germany . |
| 3429414 | 2/1985 | Germany . |
| 3638021 | 5/1987 | Germany . |
| 51-54007 | 12/1976 | Japan . |
| 56-43428 | 4/1981 | Japan . |
| 56-139829 | 10/1981 | Japan . |
| 59-5767 | 2/1984 | Japan . |
| 59-120718 | 7/1984 | Japan . |
| 60-11206 | 3/1985 | Japan . |
| 61-12940 | 1/1986 | Japan . |
| 6128715 | 2/1986 | Japan . |
| 61-144223 | 9/1986 | Japan . |
| 63-32122 | 2/1988 | Japan . |
| 6373532 | 2/1988 | Japan . |
| 63-73534 | 5/1988 | Japan . |
| 2115922 | 9/1990 | Japan . |
| 2230920 | 9/1990 | Japan . |
| 60523 | 2/1948 | Netherlands . |
| 652671 | 5/1951 | United Kingdom . |
| 1135482 | 12/1968 | United Kingdom . |
| 1293772 | of 1972 | United Kingdom . |
| 1457152 | of 1976 | United Kingdom . |
| 2016081 | 9/1979 | United Kingdom . |
| 2027796 | 2/1980 | United Kingdom . |
| 2064646 | 6/1981 | United Kingdom . |
| 2079763 | 1/1982 | United Kingdom . |
| 2087480 | 5/1982 | United Kingdom . |
| 2107780 | 5/1983 | United Kingdom . |
| 2196386 | 4/1988 | United Kingdom . |
| 2196388 | 4/1988 | United Kingdom . |
| 2242226 | 9/1991 | United Kingdom . |
| 7900501 | 8/1979 | WIPO . |
| 9114858 | 10/1991 | WIPO . |

CYLINDER HEAD ARRANGEMENT FOR INTERNAL COMBUSTION ENGINE

This application is a continuation of U.S. patent application Ser. No. 08/260,339, filed Jun. 15, 1994, now abandoned.

BACKGROUND OF THE INVENTION

This invention relates to a cylinder head arrangement for an internal combustion engine and more particularly to an improved cylinder head arrangement for an overhead cam, multiple valve per cylinder engine.

It is well recognized that the performance of an internal combustion engine can be significantly improved through the use of overhead valves. Further improvements can be realized if the overhead valves are operated by overhead mounted cam shafts and if multiple valves are employed per cylinder of the engine. However, the use of multiple valve overhead cam, internal combustion engines provide very complicated cylinder head assemblies. In addition to providing sliding support for the reciprocal motion of the valves and the porting associated therewith, it is also necessary to provide bearing support for the cam shafts and/or tappet bodies which may be interposed between the cam shafts and the valves for their actuation. If all of these bearings and passages are formed in a single cylinder head casting, the casting becomes very difficult to form and many difficult machining operations are required.

It has, therefore, been proposed to provide an overhead valve engine wherein the main cylinder head forms the support for the valves but a separate cam carrier is employed which provides the bearing surface for the tappets and/or cam shaft. Of course, with such an arrangement, it must be insured that the cam carrier is adequately affixed to the cylinder head and properly located. This requires the formation of machined surfaces between the cam carrier and the cylinder head.

In the conventional types of structures employing separate cam carriers, either the cylinder head is formed with a machined surface that extends generally parallel to its lower seating surface and the cam carrier is fastened to this machined surface or the cylinder head is provided with a machined surface that extends perpendicularly to the stems of the valves which are operated by the tappets and/or cam carried by the cam carrier.

Where, however, multiple valves are employed per cylinder, it may be desirable to position the reciprocal axes for the valves in directions that do not lie in a common plane. With this type of arrangement, it has been the practice to use a mounting surface that extends parallel to the lower sealing surface of the cylinder head. However, this requires complicated machining operation and actually has the mounting surface of the cam carrier disposed at an angle to the tappet bores which is not particularly desirable.

It is, therefore, a principal object of this invention to provide an improved cam and/or tappet carrier for a cylinder head assembly employing multiple valves per cylinder wherein the valves are disposed at angles to each other.

It is a further object to this invention to provide an improved cam/tappet carrier for a multiple valve overhead cam internal combustion engine.

Where valves are provided that are disposed at different reciprocal angles, it may be possible to simplify the construction of the cam carrier if its mounting surface is disposed so that it is perpendicular to the stems of one of the valves operated by the associated cam shaft. If there are more than two valves and two of these valves have parallel reciprocal axes, then there is an advantage to choose the perpendicular relationship to the greater number of valves.

However, in addition to the actual machining of the mounting surfaces of the cam carrier, there is still another factor to consider. It is desirable to provide a relatively low cylinder head height and where there are multiple valves per cylinder disposed at different reciprocal axes, then the question of clearance of the cam carrier and the tappets for removal of the cam carrier assembly from the cylinder head with the valves still in place is a problem.

It is desirable in many instances to provide as large a diameter for the valve springs as possible and also, to maintain a low height, to have the valve springs inserted into the tappets. However, when this is done and the mounting surface is perpendicular to the axis of one of the valves, then a greater clearance must be provided between the spring and tappet of the other valves so as to permit ease of insertion and removal of the cam carrier and/or tappets. However, the provision of such large clearances can present problems and compromise the valve spring design. Therefore, there may be some instances when it is desirable to provide a mounting surface that is not perpendicular to the axis of either of the valves per cylinder but is disposed at an angle somewhere between these two perpendicular surface angles.

It is, therefore, a still further object to this invention to provide an improved cam/tappet carrier for a multiple valve overhead cam internal combustion engine that facilitates assembly and disassembly without compromising the valve spring design.

Normally, when the use of a separate cam and/or tappet carrier is employed, it is the practice to use a plurality of separate bearing caps that are affixed to the cam carrier for journaling the cam shaft. The use of separate bearing caps has a number of disadvantages. First, it requires multiple parts and second, the individual bearing caps do not provide significant rigidity for the cylinder head. Finally, it is difficult to provide lubrication for the cam shaft bearings and cam lobes when separate bearing caps are provided. That is, in this instance, all of the oil delivery passages must be formed in the cam carrier or a multiple machining operations are required.

It is, therefore, a still further object of this invention to provide an improved arrangement for journaling the cam shafts of an overhead cam internal combustion engine.

It is a further object of this invention to provide an improved cam shaft and cylinder head arrangement for a multiple cylinder engine wherein a single bearing cap is employed for all bearings of the individual cam shafts.

SUMMARY OF THE INVENTION

A first feature of the invention is adapted to be embodied in a cylinder head arrangement for an overhead cam shaft internal combustion engine. The cylinder head has a lower surface for sealing relation around a cylinder bore of an associated cylinder block. A pair of valve seats are formed in the lower surface of the cylinder head at the termination of respective flow passages that extend through the cylinder head and which serve the cylinder bore. A pair of poppet valves have stem portions that are slidably supported about respective axes by the cylinder head and have head portions for controlling the flow through the respective valve seats. The reciprocal axes are disposed in nonparallel relationship. The stem portions extend through respective perpendicular surfaces of the cylinder head which are spaced from the lower surface. A cam shaft bearing member having a mounting surface and cooperating cylinder head mounting surface are disposed at an angle in the range of the two perpendicular surfaces.

Another feature of the invention is adapted to be embodied in a cylinder head arrangement for an overhead valve internal combustion engine. The cylinder head has a lower surface for sealing relationship around a cylinder bore of an associated cylinder block. A pair of valve seats are formed in the cylinder head lower surface at the termination of respective flow passages that extend through the cylinder head for serving the cylinder bore. A pair of poppet valves have stem portions slidably supported about respective axes by the cylinder head and head portions for controlling the flow through respective of the valve seats. The reciprocal axes of the poppet valves are disposed in nonparallel relationship. The stem portions of the valves extend through perpendicular surfaces in the cylinder head which are spaced from the lower surface. A tappet body is provided with a plurality of bores which are aligned with the axes of the valve stems and slidably support tappets for actuating the respective valves. The tappet body has a surface affixed to a mounting surface of the cylinder head that is disposed at an angle in the range between the two perpendicular surfaces of the cylinder head.

Another feature of the invention is adapted to be embodied in a cylinder head arrangement for an overhead cam shaft internal combustion engine. The cylinder head has a lower surface for sealing relationship with a plurality of cylinder bores of an associated cylinder block. At least one valve seat is formed in said cylinder head lower surface for each of the cylinder bores at the termination of a respective gas flow passage extending through the cylinder head. A plurality of poppet valves are supported for reciprocation by the cylinder head and each is adapted to control the flow through a respective one of the valve seats. A cam shaft is journalled for rotation by the cylinder head for operating the poppet valves by means of a single bearing cap having a plurality of bearing surfaces each being engaged with a respective bearing surface of the cam shaft and detachably connected to the cylinder head.

DETAILED DESCRIPTION OF THE PREFERRED EMBODIMENT OF THE INVENTION

Figure 1:
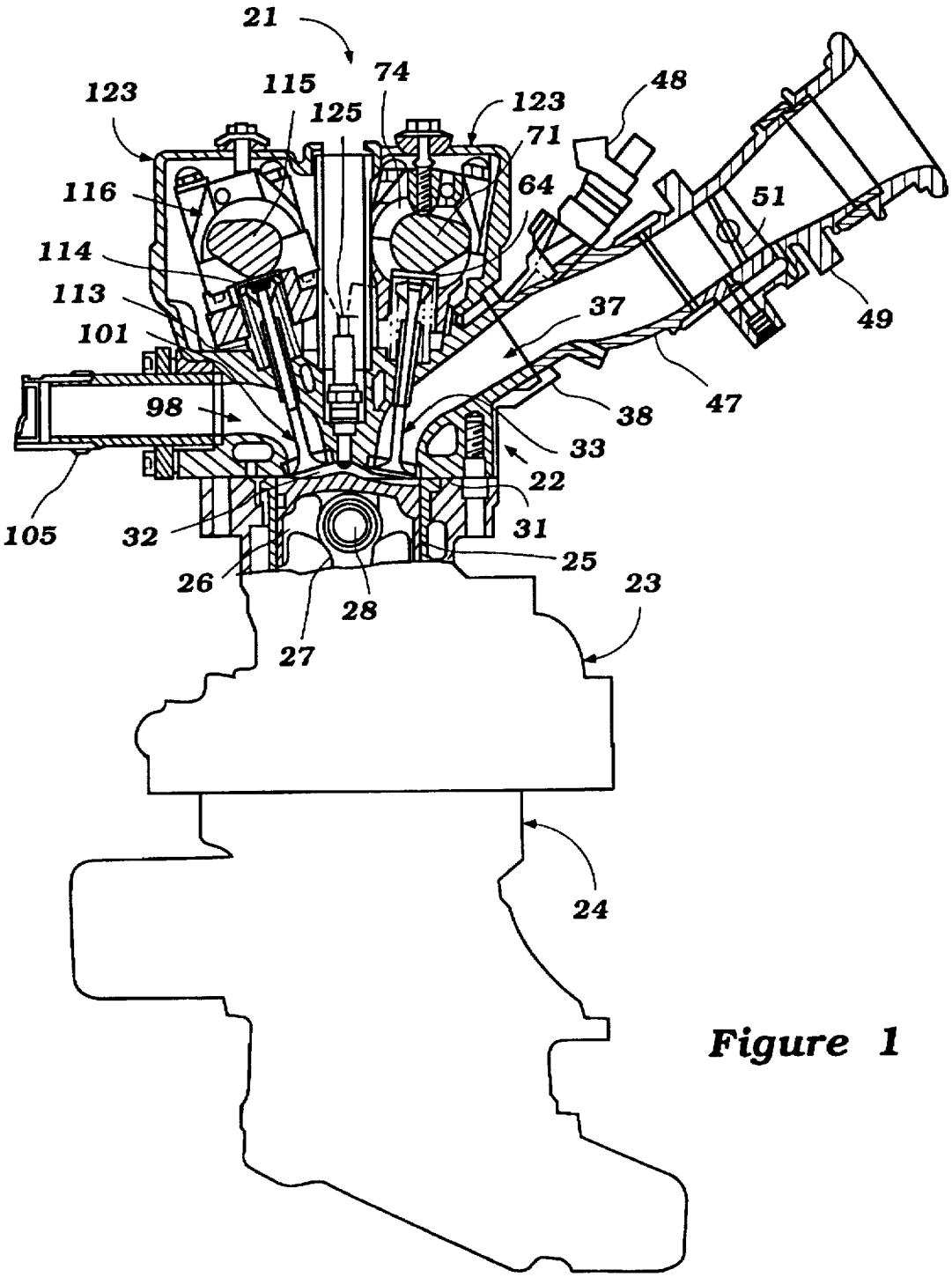
FIG. 1 is a side elevational view of an internal combustion engine constructed in accordance with a first embodiment of the invention and coupled to a transmission final drive arrangement for driving a motorcycle, with a portion of the cylinder head and upper portion of the cylinder block broken away and shown in sections.

Referring now in detail to the drawings and initially to FIG. 1, an internal combustion engine constructed in accordance with an embodiment of the invention is identified generally by the reference numeral 21. The engine 21 in the illustrated embodiment is of the two cylinder in-line type. It will be readily apparent to those skilled in the art, however, how the invention may be employed in conjunction with engines having other cylinder numbers and other cylinder configurations such as V-type and opposed types. It will be readily apparent, however, that certain facets of the invention have utility in conjunction with cylinder head assemblies that are associated with cylinder blocks having multiple cylinders.

The engine 21 includes a cylinder head assembly, indicated generally by the reference numeral 22, and which has a construction as will be best understood by reference to the remaining figures of this embodiment. This cylinder head assembly 22 is affixed, in a manner which will be described, to a cylinder block assembly 23 which, in turn as is typical with motorcycle practice, is affixed to a crankcase assembly 24 which also contains a change speed transmission and final drive for driving the driven wheel of the associated motorcycle in a well known manner.

The cylinder block 23 is formed with a pair of aligned cylinder bores formed by cylinder liners 25 that are cast or pressed into the cylinder block 23 in a well known manner. Pistons 26 are slidably supported for reciprocation in each of the cylinder bores and are connected to the upper ends of respective connecting rods 27 by piston pins 28 in a well known manner. The lower ends of these connecting rods 27 are journalled on a crankshaft contained within the crankcase transmission assembly 24 as is well known in this art. Since the invention deals with the cylinder head assembly, further description of the crankcase assembly and transmission is not believed to be necessary to understand the construction and operation of the invention.

The invention, as has been noted, deals with the construction of the cylinder head assembly 22 and this construction will be described in more detail by reference to the remaining figures of this embodiment (FIGS. 2–11). The cylinder head assembly 22 includes a main cylinder head casting, indicated generally by the reference numeral 29, which has a lower sealing surface 31 that is adapted to be affixed, in the manner to be described, to the cylinder block 23 in sealing arrangement around the cylinder bores formed by the liners 25. This lower surface 31 is provided with individual combustion chamber recesses 32 each of which cooperates with a respective one of the pistons 26 and cylinder bores formed by the liners 25 to form a variable volume chamber, referred to hereinafter as the combustion chamber.

The cylinder head assembly 22 is of the multiple valve type and more specifically in a preferred embodiment of the invention is of the five valve type having three intake valve and two exhaust valves per cylinder. These intake and exhaust valves are disposed in a relationship to the cylinder bore axis as described in U.S. Pat. No. 4,660,529, entitled 4-Cycle Engine, issued Apr. 28, 1987 in the name of Masaaki Yoshikawa now reissued as RE33,787 on Jan. 7, 1992, the disclosure of which is incorporated herein by reference.

The three intake valves are comprised of a center intake valve, indicated generally by the reference numeral 33 and a pair of side intake valves, each indicated by the reference numeral 34. The center intake valve 33 has a head portion 35 that cooperates with a respective valve seat 36 positioned in the combustion chamber recess 32 of the cylinder head 29 in a known manner and formed at one end of an intake passage 37 which extends through the cylinder head casting 29 and terminates an exterior surface 38 thereof.

The center intake valve 33 has a stem portion 39 that is slidably received in a valve guide 41 suitably affixed to the cylinder head and which defines a reciprocal axis, shown at $\theta_c$ in FIG. 3 which axis is disposed relative to a plane n, which will be described but which plane is parallel to a longitudinally extending plane containing the axes of the cylinder bores of the liners 25. This acute angle is relatively small as noted in the aforenoted U.S. Patent.

The side intake valves 34 have head portions 42 that cooperate with respective valve seats 43 which are affixed in the cylinder head casting 29 in the combustion chamber recess 32 and which are formed at the termination of intake gas flow passages 44 formed in the cylinder head casting 29. The passages 44 and 37 are siamesed and terminate in a common opening in the cylinder head surface 38.

The side intake valves 34 each have respective valve stems 45 that are slidably supported about reciprocal axes defined by valve guides 46 formed in the cylinder head casting 29 in a known manner. The valve guides 46 define respective reciprocal axes that lie in a common plane and which plane is disposed at an angle $\theta_s$ to the plane n and to the plane containing the cylinder bore axis. The angle $\theta_s$ is, as described in the aforenoted patent, a greater angle than the angle $\theta_c$. The reciprocal axes of the center intake valve 33 and the side intake valves 34 intersect along a common line as also described in the aforenoted patent and which will be described later.

Referring again to FIG. 1, an intake manifold 47 is affixed to the cylinder head surface 38 through which the intake passages 37 and 44 extend. This intake manifold is provided with fuel injectors 48 that spray fuel into the openings of the intake passages 37 and 44 for distribution to the combustion chamber 32 in a known manner.

A throttle body 49 is affixed to the intake manifold 47 and contains butterfly type throttle valves 51 that are operated in a suitable manner so as to control the speed of the engine 21. The throttle body 49 communicates with an air inlet device such as a plenum chamber having an air inlet (not shown) in a well known manner.

The upper part of the cylinder head casting 29 is provided with a first machined surface 52 that extends perpendicularly to the axis of the valve stem 39 of the center intake valve 33. A coil compression spring assembly 53 bears against this surface 52 or an intervening bearing attached thereto at one end and against a keeper retainer assembly 54 that is affixed to the upper end of the valve stem 39 at the other end for urging the center intake valve 33 to its closed position. In addition, the cylinder head casting 29 is provided with a pair of second machined surfaces 55 that extend perpendicularly to the stems 45 of the side intake valves 34. Coil compression springs 56 bear against these surfaces and keeper retainer assemblies 57 that are affixed to the upper ends of the stems 45 for urging the side intake valves 34 to their closed positions.

A single cam carrier and tappet body supporting member, indicated generally by the reference numeral 58 is provided on the intake side of the cylinder head assembly 22. This member 58 has a lower surface 59 which is machined and which is held in abutting relationship with a surface 61 of the cylinder head which is also machined. Threaded fasteners 62 affix this member 58 to the cylinder head casting 29.

As has been previously noted, the lower surface 59 of the member 58 and the surface 61 of the cylinder head are disposed at an angle to the lower cylinder head sealing surface 31. This angle is chosen to be in the range between the angles of the cylinder head machined surfaces 52 and 55 which are perpendicular to the center intake valve 33 or side intake valves 34, respectively. If they are chosen to be parallel to one of these perpendicular planes, there is an advantage to picking the surface that is perpendicular to the greater number of valves, in this case the side valves 34. However, as has been previously noted, this can require greater clearance between the tappet body, to be described, and the coil springs associated with the remaining intake valves. Therefore, in some embodiments it may be desirable to select an angle between the angles of the machined surfaces 52 and 55. In the illustrated embodiments, the mounting surfaces 59 and 61 are parallel to those of the side intake valve coil spring seating surfaces 55.

The member 58 is provided with a first pair of bores 63 which extend parallel to and are spaced outwardly from the coil springs 56 associated with the side intake valves 34. Tappets 64 are slidably supported in these bores and are engaged with adjusting shins for operating the side intake valves 34 in a manner which will be described. In a similar manner, there is provided a single bore 65 which is parallel to and spaced outwardly from the coil spring 53 associated with the center intake valve 54 and which receives a tappet 66 for operating this center intake valve 33.

It should be noted that the areas of the cylinder head where the fasteners 62 are received are formed with small bores 67 (FIG. 11) so as to receive locating pins for locating the cam carrier and tappet member 58 relative to the cylinder head casting 29.

The member 58 is provided with a plurality of cylindrical recesses 69 (FIGS. 8 and 10) that receive the bearing portions 25 of an intake cam shaft, indicated generally by the reference numeral 72. The intake cam shaft 72 has its rotational axis defined by these bearing surfaces 69 and this rotational axis is coincident with the intersecting line of the axes of reciprocation of the intake valves 34 and 35, aforereferred to. The intake cam shaft 72 is provided with cam lobes 73 that are disposed between these bearing surfaces 71 and which engage each of the tappets 64 and 66 for operating the intake valves 33 and 34 in a well known manner.

A single bearing cap, indicated generally by the reference numeral 74 is provided with cylindrical bearing surfaces 75 that complete the journaling for the cam shaft bearing surfaces 25. This bearing cap 74 is provided with a plurality of spaced openings that receive threaded fasteners 76 that are tapped into tapped openings in the member 58 for affixing the bearing cap 74 to the member 58.

By providing a single unitary bearing cap 74 for all of the cam shaft bearing surfaces 25, it is possible to rigidify the cylinder head assembly. Also, this single unitary bearing cap 74 provides a way in which the cam shaft and tappet bodies 66 can be lubricated. This lubrication system can be best understood by reference to FIGS. 6–11.

It should be noted that the cylinder head is provided with a plurality of openings 77 that pass threaded fasteners for affixing the cylinder head casting 29 to the cylinder block 23. The center of these passages 77 is enlarged and provides a clearance to provide an oil passage that extends up from the cylinder block to the cylinder head. A cross drilling 78 (FIG. 11) intersects the cylinder block 61 surface to which the member 58 is affixed. A drilled passage 79 (FIGS. 7 and 8) intersects this passage 78 and delivers oil to the member 58. A further cross drilled passage 81 is closed by a plug 82 and delivers the lubricant to a further passageway 83 in which one of the set of fasteners 76 is provided. Lubricant therefore can flow upwardly to a passageway 84 formed in the bearing cap 74 around this fastener.

The bearing cap 74 is provided with a longitudinally drilled main oil gallery 85 which is served by this passageway 84 through a further cross drilling 86 in the bearing cap 74 which is closed on its outer surface by a plug 87 and which intersects one of a plurality of vertical drillings 88 formed in the bearing cap 74 and closed at their upper ends by caps 89. Hence, lubricant is delivered to this main oil gallery 85 at the bearing cap 74 as described.

The bearing cap 74 is provided with drillings 91 (FIGS. 8 and 10) that extend from their bearing surfaces 75 to the drillings 88 and thus receive oil from the main oil gallery 85 and deliver it to the cam shaft bearing surfaces for their lubrication.

In addition, in the areas of the cam lobe 73, the bearing cap 74 is provided with a cutaway surface 92 for clearance and a drilling 93 extends from each cutaway 92 to the main oil gallery 85 (FIGS. 2, 3, and 9) for delivering oil to the cam lobes 73 and also the tappets 64 and 66. Hence, the unitary bearing cap 74 provides a very effective way in which lubricant can be supplied to the cam shaft 71 and tappets 64 and 66.

As has been previously noted, the cylinder head casting 29 is provided with openings 77 to receive fasteners for affixing the cylinder head 29 to the cylinder block 23. The bearing cap 74 and members 58 are provided with a plurality of openings 94 through which a tool may be passed so as to facilitate tightening of these threaded fasteners without removal of the cam assembly.

The cylinder head member 29 is provided with a cam shaft driving cavity 95 (FIGS. 4 and 11) at one end thereof into which the intake cam shaft 71 extends. A timing gear 96 is affixed to the intake cam shaft 71 in this cavity 95 and is driven in timed relationship to the engine crankshaft through a gear drive provided in part in this cavity as is well known in this art.

The intake system as thus far described and particularly the heads 35 and 42 of the intake valves 33 and 34, respectively, lie on one side of a plane containing the axis of the cylinder bore although the side intake valve heads 42 extend slightly over this plane. On the opposite side of the cylinder head, there are provided a pair of exhaust valve seats 97 that are formed at the end of exhaust passages 98 that extend from the combustion chamber recess 32 to exhaust ports 99 formed in the outer side of the cylinder head member 29.

Exhaust valves 101 have head portions 102 that cooperate with the exhaust valve seats 97 for controlling the flow through them. These exhaust valves 101 have stem portions 103 that are slidably supported within valve guides 104 fixed in the cylinder head member 29 in a known manner. The exhaust valves 101 have their stems 103 reciprocal along axes that lie in a common plane which plane is disposed at the angle θ (FIG. 2) to the axis of reciprocation of the center of intake valves 33. In addition, the reciprocal axes of the exhaust valves 101 are disposed at an angle to a vertical plane containing the cylinder bore axis and the plane n which is greater than the angle $\theta_c$ of the center intake valve and less than the angle $\theta_s$ of the side intake valves, as also described in the aforenoted patent.

An exhaust manifold 105 is affixed to the exhaust ports 99 by fasteners 106 and discharges the exhaust gases to the atmosphere through a suitable exhaust system (not shown). Exhaust valve springs 107 encircle the exhaust valves 101 and act against machined surfaces formed in the cylinder head member 29 and keeper retainer assemblies 108 affixed to the upper ends of the valve stems 103 for urging the exhaust valves 101 to their closed positions.

A combined cam carrier and tappet body member, indicated generally by the reference numeral 109 has a machined lower surface 111 that is engaged with a machined upper surface 112 of the cylinder head member 29 and held thereto by fasteners 110. The surface 112 is perpendicular to the bearing surface for the exhaust valve springs 107 and perpendicular to the axis of the valve stems 103. This member 109 has bores 113 that slidably receive tappets 114 for operating the exhaust valves 101 in a well known manner.

The member 109 also is formed with bearing surfaces like those of the member 58 for journaling an exhaust cam shaft 115. A unitary bearing cap 116 having a construction similar to that of the bearing cap 74 is affixed to the member 109 by threaded fasteners 117. A main oil gallery 118 extends through the unitary bearing cap 116 and receives lubricant from the engine in the same manner as that described in conjunction with the intake cam shaft and, for that reason, this construction will not be described again. As with the intake cam shaft 71, the bearing surfaces, cam lobes and tappet bodies 114 on the exhaust side of the engine are lubricated in the manner as aforedescribed.

The bearing cap 116 also has openings 120, which are disposed above the cylinder head hold down bolt hole openings 77 for permitting the fasteners to be tightened through an appropriate tool.

The exhaust cam shaft 115 has affixed to it a gear 119 in the drive cavity 95 of the cylinder head 29 so as to permit driving of the exhaust cam shaft 115 from the engine crankshaft through the aforedescribed gear train in a well known manner.

Figure 2:
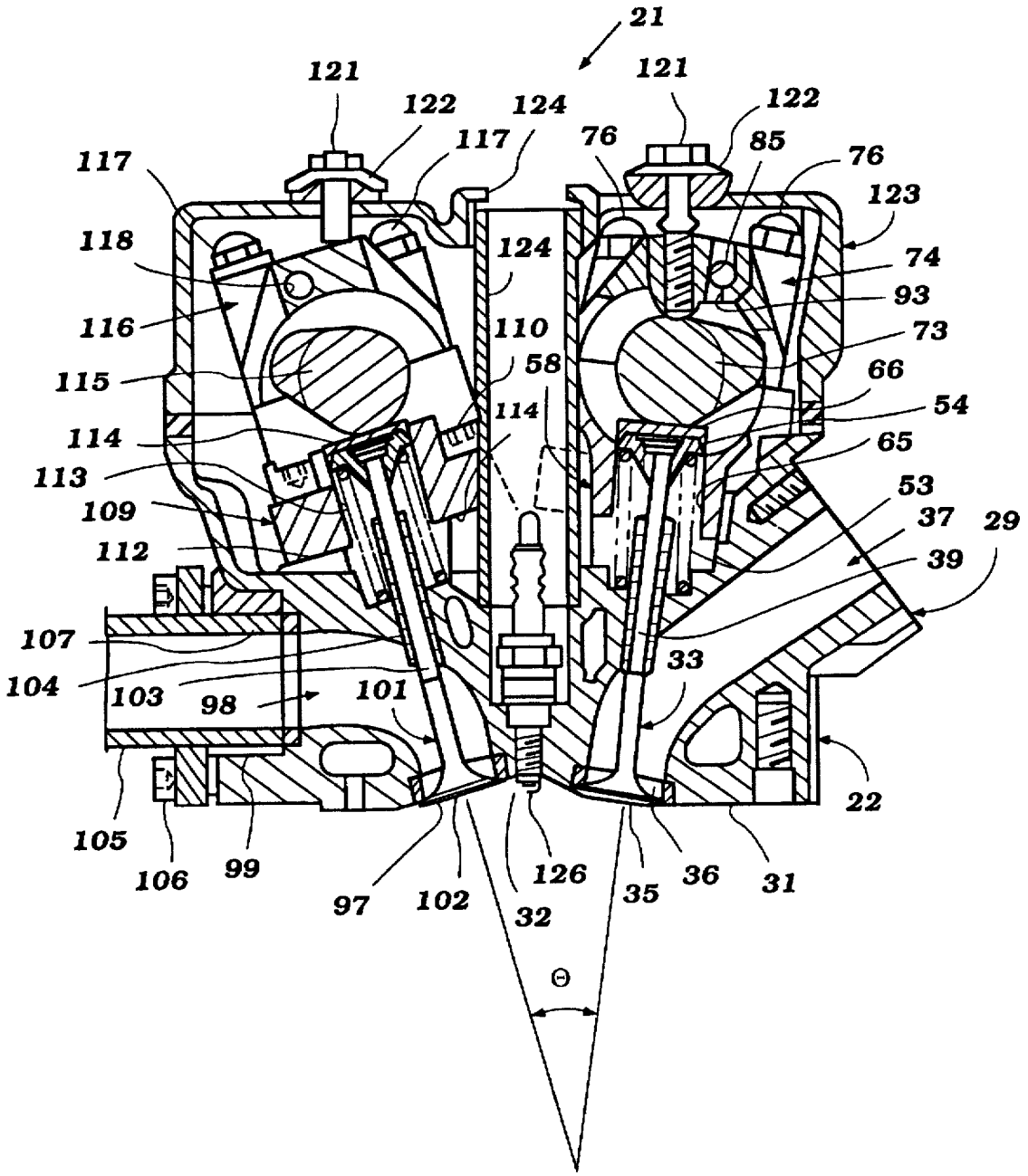
FIG. 2 is an enlarged cross sectional view of the portion of the cylinder head shown in section in FIG. 1 taken along the line 2—2 of FIG. 5 with the intake manifold removed.
Figure 3:
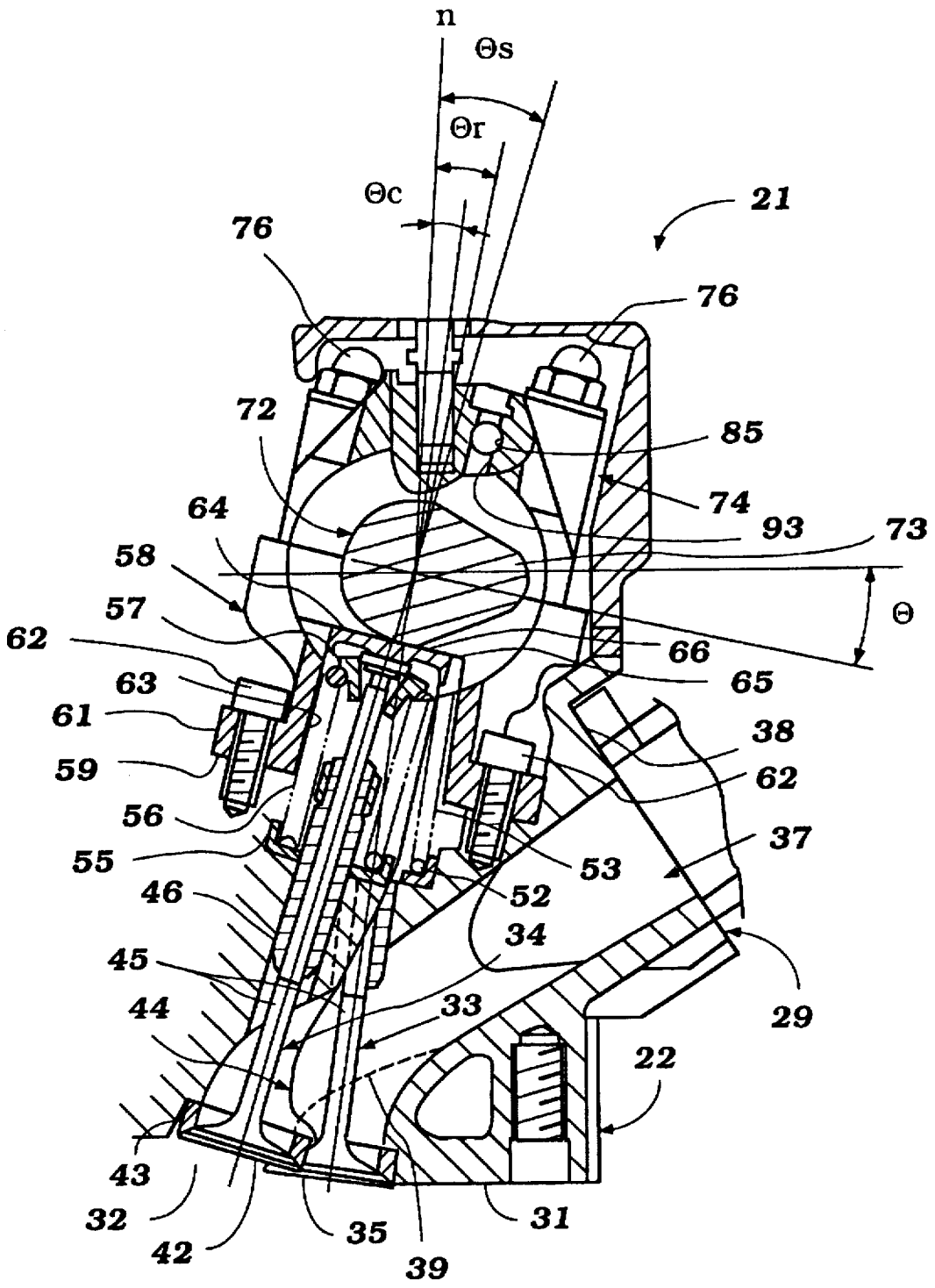
FIG. 3 is a cross-sectional view of a portion of the cylinder head taken along the line 3—3 of FIG. 5.

The bearing caps 74 and 116 are each provided with tapped holes, one of which appears in FIGS. 2 and 3 and which receive threaded fasteners 121 with sealing grommets 122 for affixing a cam cover 123 to the cylinder head member 29.

The cam cover 123 is formed with openings 124 that receive tubes 125 so as to pass spark plugs 126. The spark plugs 126 are threaded into tapped holes 127 formed centrally in the combustion chamber recess 32 for firing the charge therein in a well known manner.

Figure 4:
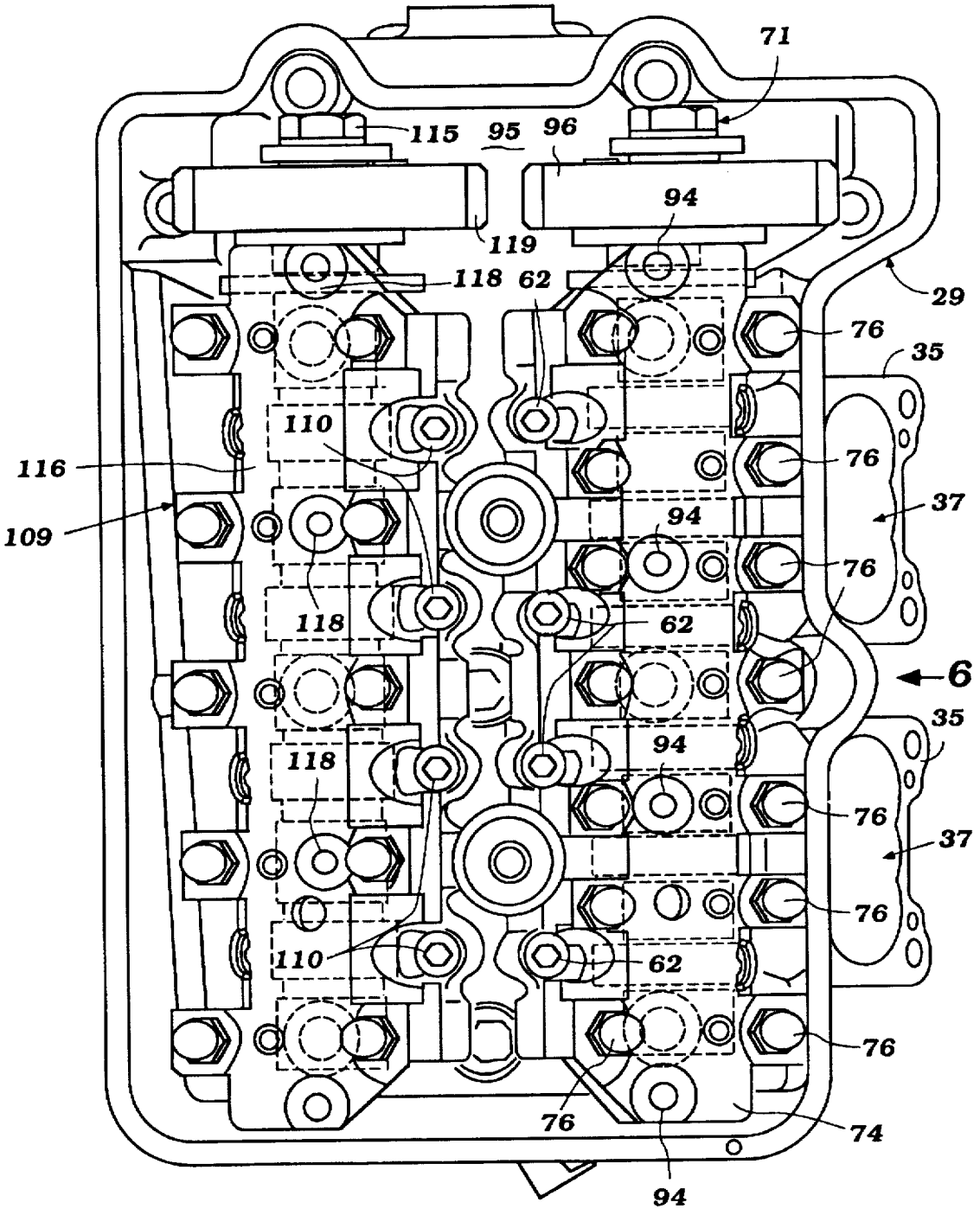
FIG. 4 is an enlarged top plan view of the cylinder head with the cam cover removed.
Figure 5:
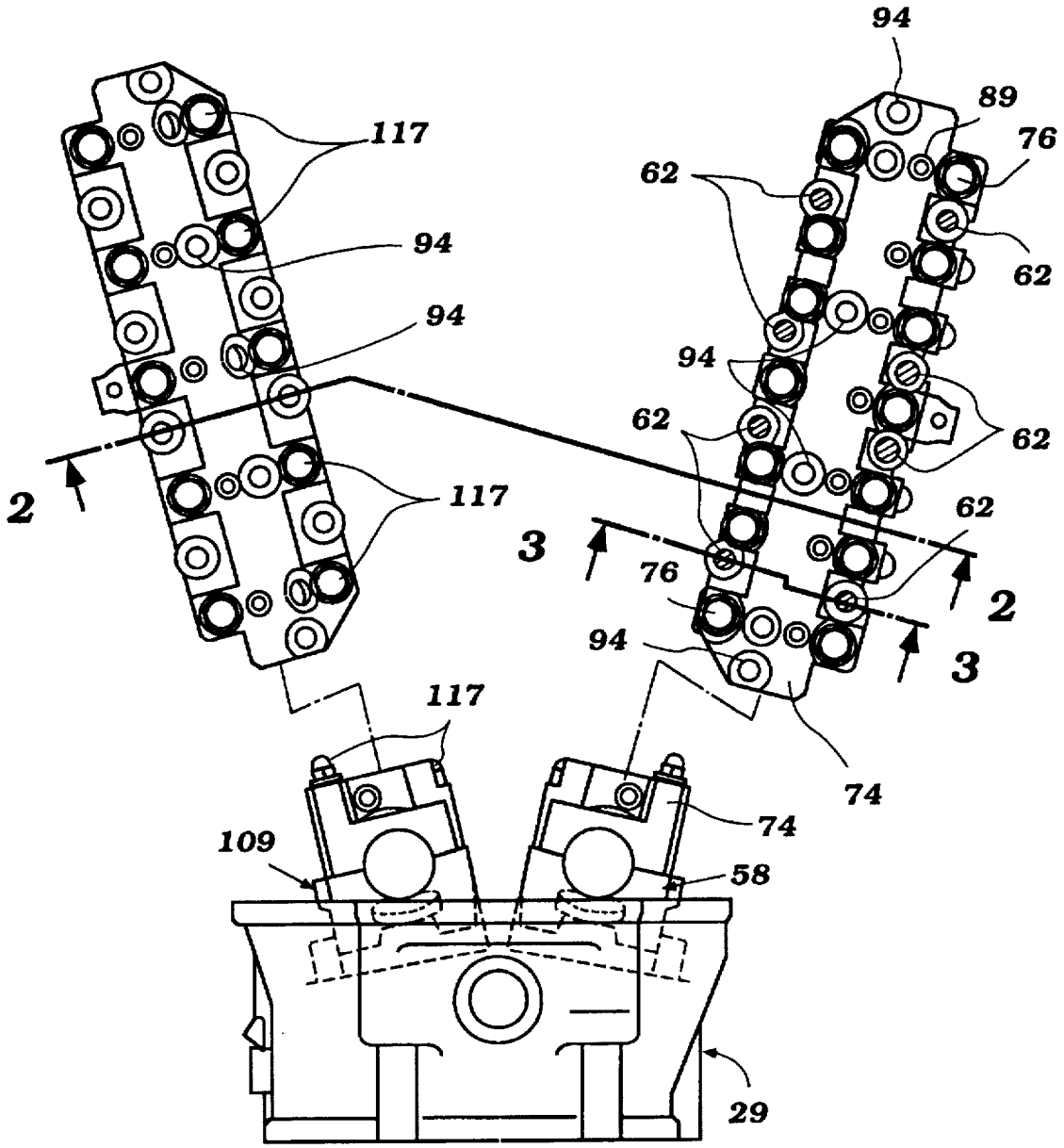
FIG. 5 is a partially exploded end elevational view of the cylinder head with the cam carrier assemblies being rotated through 90°.
Figure 6:
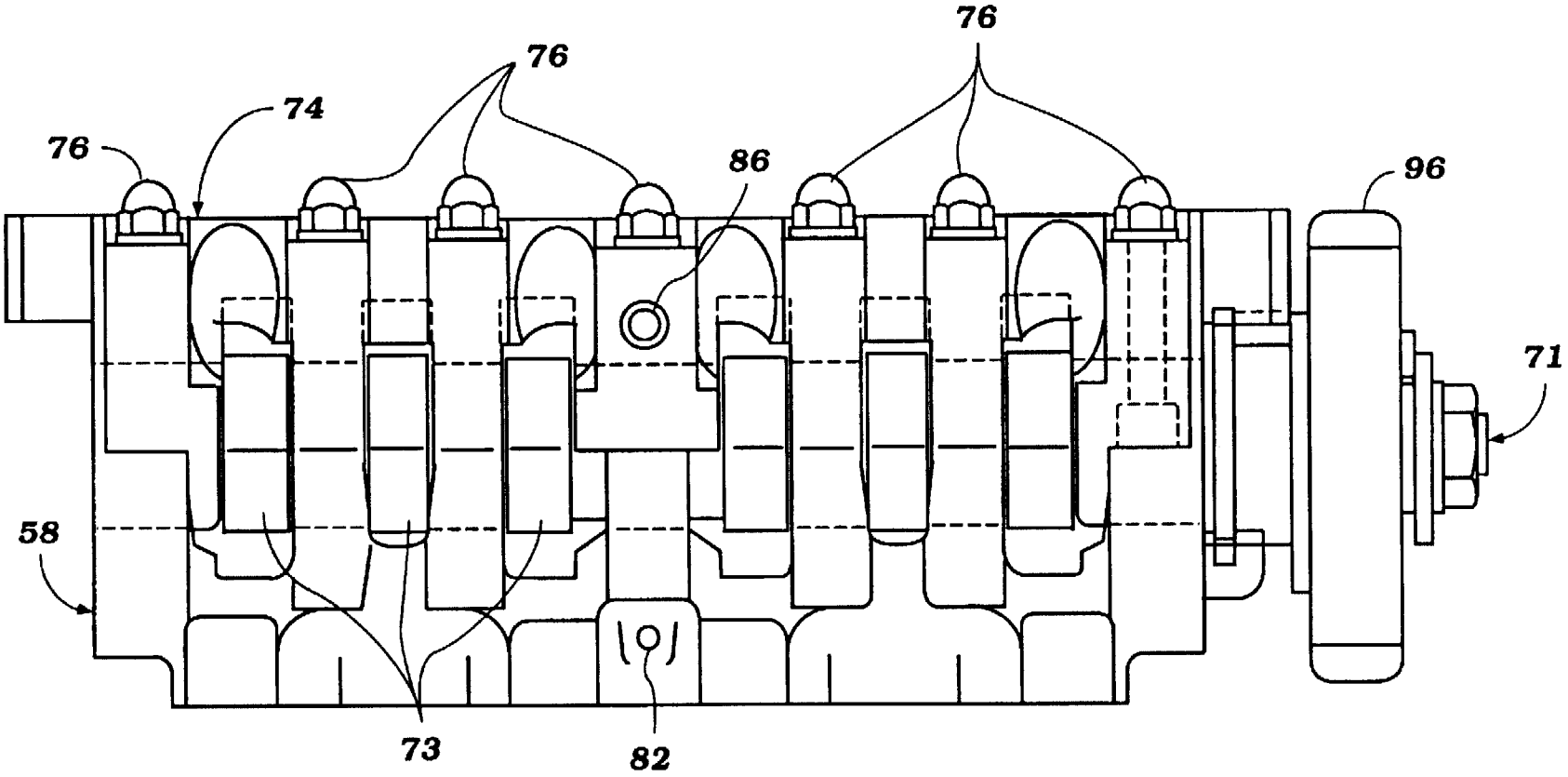
FIG. 6 is a side elevational view of the cylinder head assembly looking generally in the direction of the arrow 6 in FIG. 4.
Figure 7:
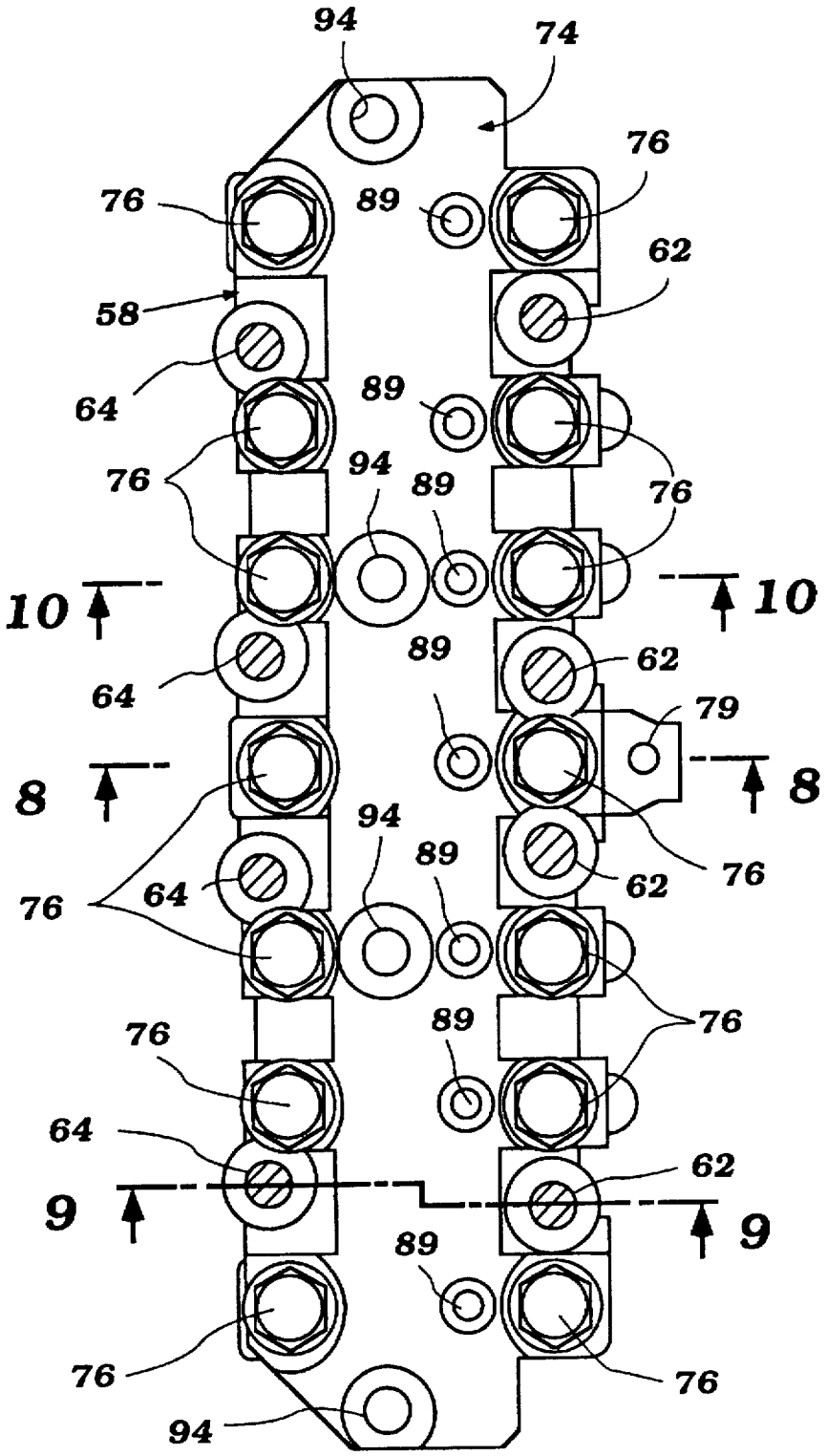
FIG. 7 is an enlarged top plan view of the cam carrier and tappet body arrangement of the intake cam shaft.
Figure 8:
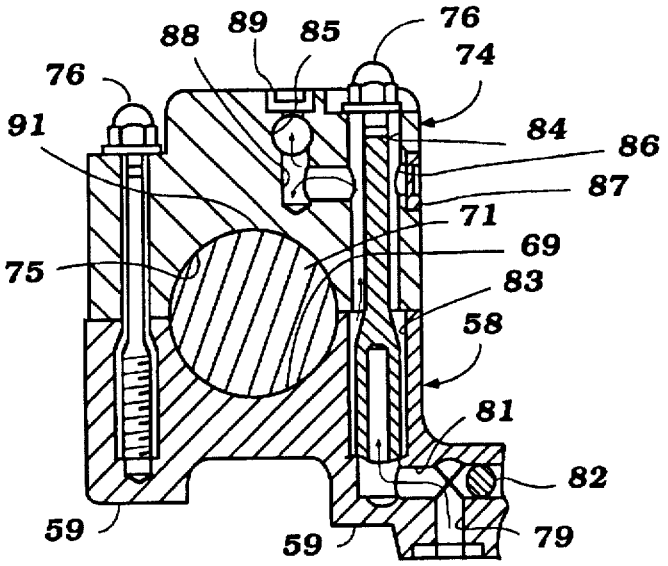
FIG. 8 is a cross-sectional view taken along the line 8—8 of FIG. 7 and shows how the lubricant is delivered from the cylinder head to the cam carrier tappet body assembly.
Figure 9:
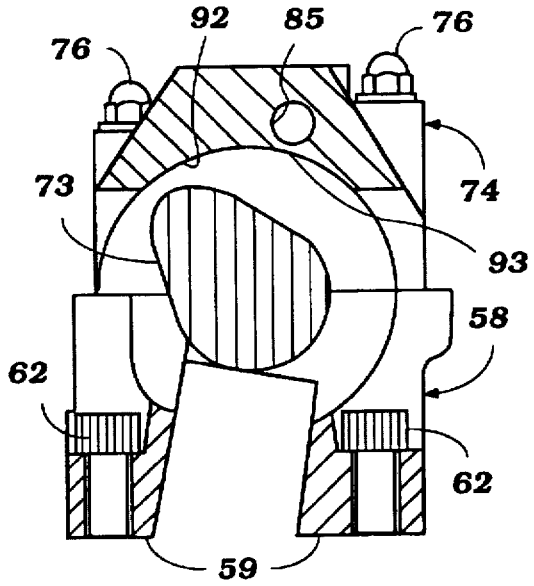
FIG. 9 is cross-sectional view taken along the line 9—9 of FIG. 7 and shows how the lubricant is delivered to the individual cam lobes.
Figure 10:
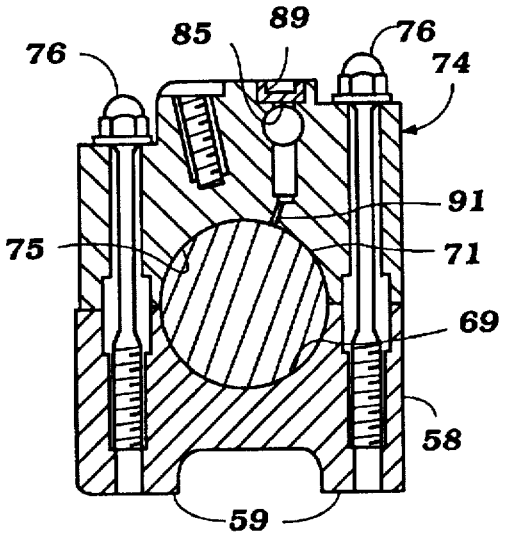
FIG. 10 is a cross-sectional view taken along the line 10—10 of FIG. 7 and shows how the lubricant is delivered to the bearing surfaces of the cam shaft and tappet body and cam carrier.
Figure 11:
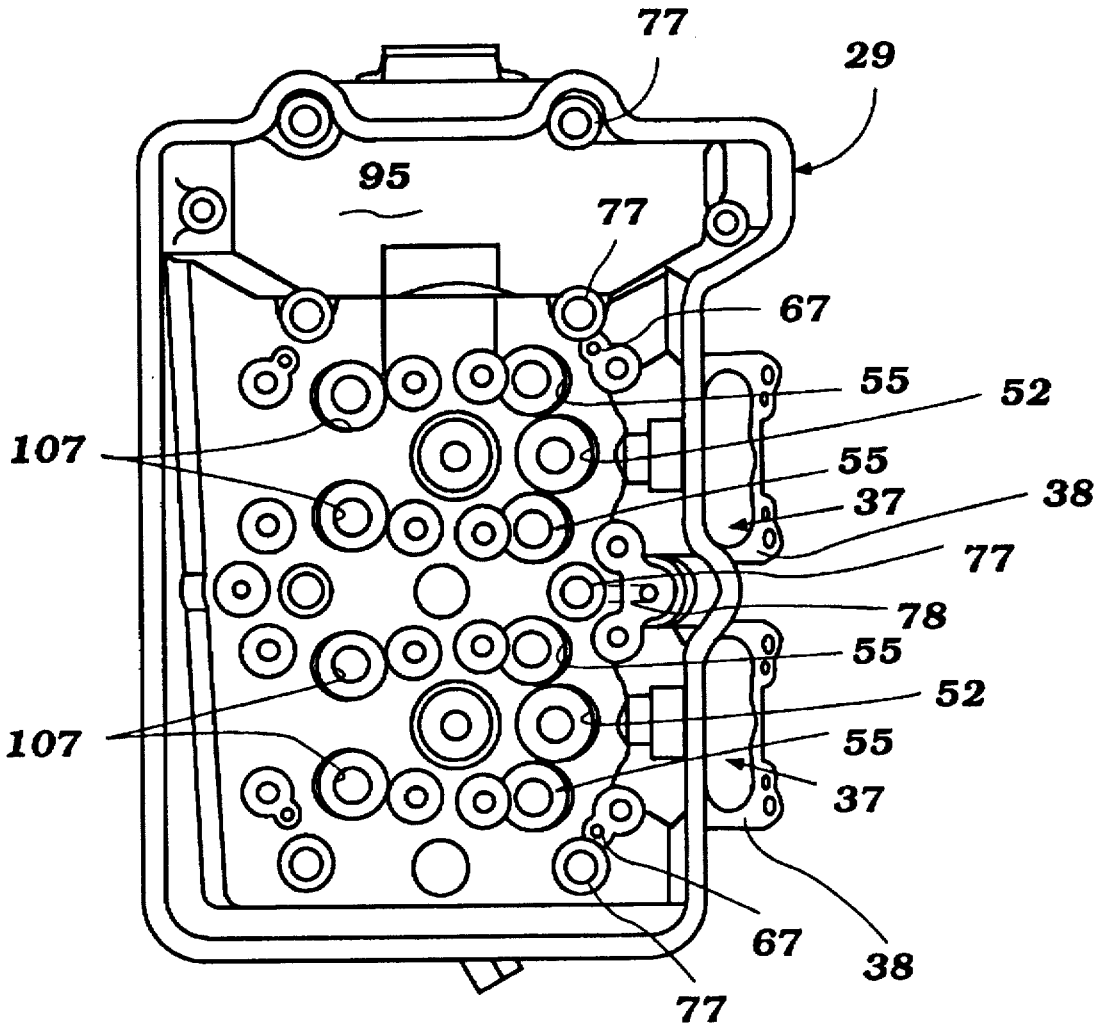
FIG. 11 is a reduced scale top plan view of the cylinder head casting with the poppet body and cam carrier assembly removed.
Figure 12:
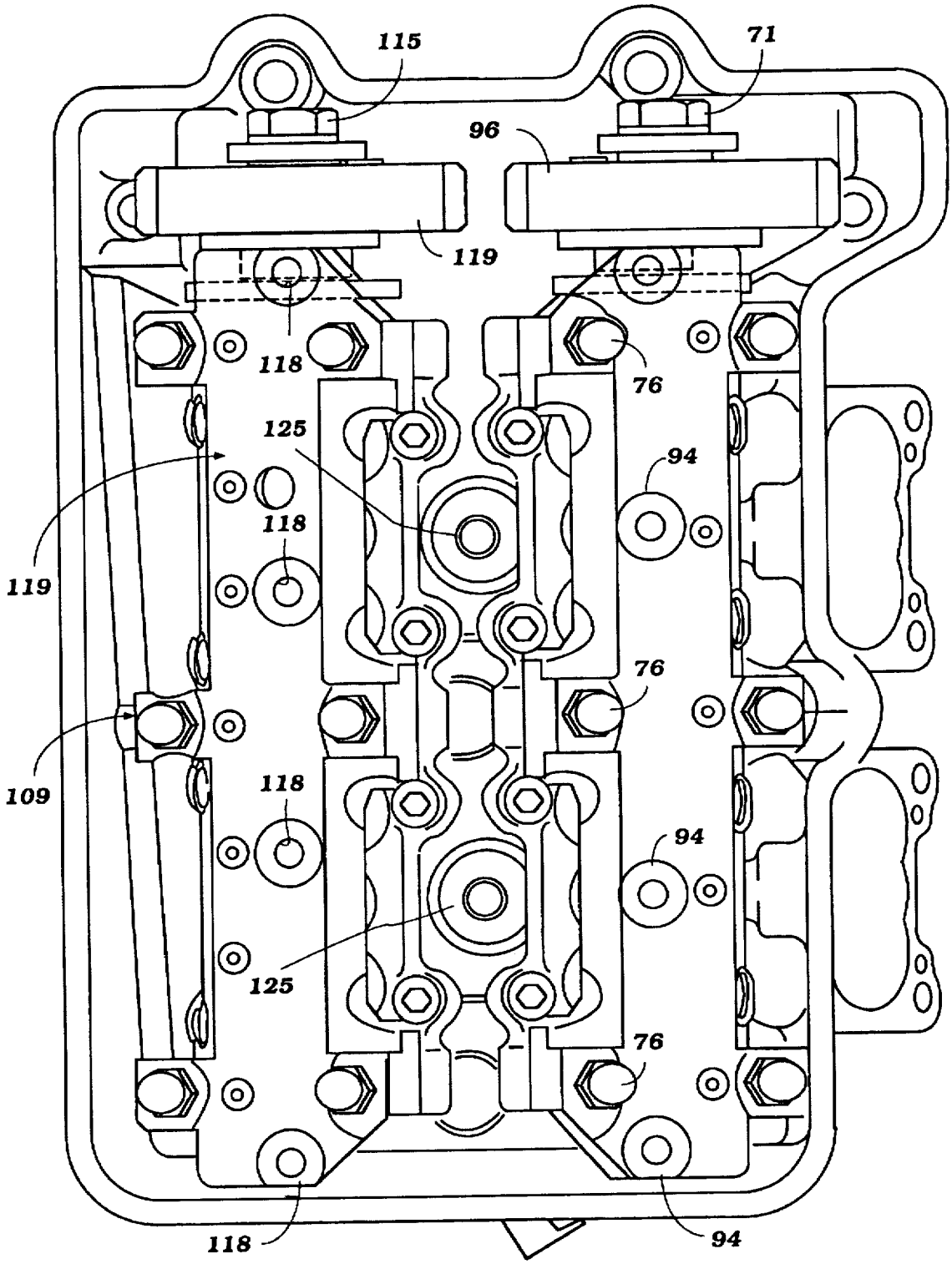
FIG. 12 is a top plan view, in part similar to FIG. 4, showing another embodiment of the invention.

FIG. 12 is a top plan view in part similar to FIG. 4 and shows a slightly modified form of the invention wherein the only difference between the previously described embodiment is a reduction in the number of threaded fasteners. In this figure, where components are the same or substantially the same as those previously described they have been identified by the same reference numerals and further description of this embodiment is believed to be unnecessary.

It should be readily apparent from the foregoing description that the described embodiments of the invention provide a very simplified cylinder head arrangement and nevertheless one in which the cylinder head casting itself can be simplified and through the use of a unitary cam carrier, tappet body and unitary bearing cap can be strong, provide good lubrication and ease of assembly. Of course, the foregoing description is that of a preferred embodiment of the invention and various changes and modifications may be made without departing from the spirit and scope of the invention, as defined by the appended claims.

I claim:

1. A cylinder head arrangement for an overhead cam shaft internal combustion engine, said cylinder head having a planar lower surface for sealing relation around a cylinder bore of an associated cylinder block, a recess formed in said lower surface in confronting relation to the associated cylinder bore for forming a combustion chamber, said cylinder head having a peripheral wall on an upper side thereof opposite said planar lower surface and adapted to be engaged by a cam cover to form a closure around said peripheral wall containing a valve actuating mechanism, a pair of valve seats formed in said recess at the termination of respective flow passages extending through said cylinder head, a pair of poppet valves each having stem portions slidably supported along respective axes by said cylinder head and having head portions for controlling the flow through respect of said valve seats, said poppet valve axes being disposed in nonparallel relationship, each of said stem portions extending through a respective one of a pair of machined spring engaging surfaces in said cylinder head located below and surrounded by said peripheral wall, said machined spring engaging surfaces each being perpendicular to the respective stem portion and being spaced from said planar lower surface and lying at an angle thereto, and a cam shaft bearing member having a mounting surface affixed to a cylinder head mounting surface that is disposed at an angle to said cylinder head lower surface, which angle is equal to the angle of one of the two machined spring engaging cylinder head surfaces to said cylinder head lower surface, said cam shaft bearing member journaling cam shaft means for operating said valves, a pair of coil compression springs, each encircling a respective one of said valve stems and engaged at one end thereof with a respective one of said machined spring engaging surfaces of said cylinder head, keeper retainer assemblies affixed to the ends of said valve stems and engaged by the other ends of the respective of said coil compression springs, said chin shaft bearing member having a pair of bores formed therein, each encircling a respective one of said coil compression springs.

2. The cylinder head arrangement for an overhead cam shaft internal combustion engine as defined in claim 1, further including a third valve seat in the recess of the cylinder head and terminating at a respective flow passage extending through the cylinder head and a third poppet valve having a stem portion slidably supported a respective axis by said cylinder head, said third poppet valve having a head portion for controlling the flow through said third valve seat, said reciprocal axis of said third valve being in nonparallel relationship to the reciprocal axis of at least one of said pair of poppet valves.

3. The cylinder head arrangement for an overhead cam shaft internal combustion engine as defined in claim 2, wherein the reciprocal axis of the third poppet valve is parallel to the reciprocal axis of the other of the pair of poppet valves.

4. The cylinder head arrangement for an overhead cam shaft internal combustion engine as defined in claim 3, wherein the mounting surface of the cam shaft bearing member is parallel to a third machined spring engaging surface of the cylinder head associated with the third poppet valve and perpendicular to the stem of said third poppet valve, said respective spring engaging surface being perpendicular to said third poppet valve stem, and a third coil compression spring encircling said third poppet valve stem and engaged with said third machine spring engaging surface of said cylinder head and a keeper retainer assembly affixed to said third poppet valve stem for urging said third poppet valve to its closed position, said cam shaft bearing member having a third bore encircling said third coil compression spring.

5. The cylinder head arrangement for an overhead cam shaft internal combustion engine as defined in claim 1, wherein the cylinder block has a plurality of cylinder bores and the cylinder head has a plurality of recesses in its planar lower surface each associated with a respective cylinder bore, there are provided a pair of valve seats and poppet valves for each of the cylinder head recesses.

6. The cylinder head arrangement for an overhead cam shaft internal combustion engine as defined in claim 5, further including a common bearing cap member affixed to said cam shaft bearing member for journaling the cam shaft in the cylinder head.

7. The cylinder head arrangement for an overhead cam shaft internal combustion engine as defined in claim 6, further including lubricating passage means formed in the common bearing cap member for lubricating the cam shaft.

8. The cylinder head arrangement for an overhead cam shaft internal combustion engine as defined in claim 7, wherein the lubricating passage means lubricates bearing surfaces and lobes of the cam shaft.

9. The cylinder head arrangement for an overhead cam shaft internal combustion engine as defined in claim 8, wherein the bearing cap member lubricating passage means comprises a main oil gallery drilled longitudinally therethrough and intersected by cross drilled passageways for lubricating and bearing surfaces and the cam shaft lobes and further including a passageway extending through the bearing cap member and the cam shaft bearing member and supplied with oil from the associated cylinder head and intersecting the main oil gallery of the bearing cap member.

10. The cylinder head arrangement for an overhead cam shaft internal combustion engine as defined in claim 5, further including a plurality of third valve seats each formed in a respective recess of the cylinder head and terminating at a respective flow passage extending through the cylinder head to the respective cylinder bore and third poppet valves having a stem portions slidably supported along respective axes by said cylinder head, each of said third poppet valves having head portions for controlling the flow through respective of said third valve seats, the reciprocal axes of said third valve being in nonparallel relationship to the reciprocal axis of at least one of said pair of poppet valves.

11. The cylinder head arrangement for an overhead cam shaft internal combustion engine as defined in claim 10, wherein the reciprocal axis of the third popper valve is parallel to the reciprocal axis of the other of the pair of poppet valves.

12. The cylinder head arrangement for an overhead cam shaft internal combustion engine as defined in claim 9, wherein the mounting surface of the cam shaft bearing member is parallel to the machined spring engaging surface associated with the third poppet valve.

13. The cylinder head arrangement for an overhead cam shaft internal combustion engine as defined in claim 12, further including a common bearing cap member affixed to said cam shaft bearing member for journaling the cam shaft in the cylinder head.

14. The cylinder head arrangement for an overhead cam shaft internal combustion engine as defined in claim 12, further including lubricating passage means formed in the common bearing cap member for lubricating the cam shaft.

15. The cylinder head arrangement for an overhead cam shaft internal combustion engine as defined in claim 14, wherein the lubricating passage means lubricates the bearing surfaces and lobes of the cam shaft.

16. The cylinder head arrangement for an overhead cam shaft internal combustion engine as defined in claim 15, wherein the bearing cap member lubricating passage means comprises a main oil gallery drilled longitudinally therethrough and intersected by cross drilled passageways for lubricating the bearing surfaces and the cam shaft lobes and further including a passageway extending through the bearing cap member and the cam shaft bearing member and supplied with oil from the associated cylinder head and intersecting the main oil gallery of the bearing cap member.

17. The cylinder head arrangement for an overhead cam shaft internal combustion engine as defined in claim 12, further including a plurality of tappet bores formed in the cam shaft bearing member, one for each poppet valve for slidably receiving a tappet for operating respective poppet valves.

18. The cylinder head arrangement for an overhead cam shaft internal combustion engine as defined in claim 17, wherein the tappet receiving bores extend parallel to the respective poppet valve stem axes.

19. A cylinder head arrangement for an overhead valve internal combustion engine, as set forth in claim 1 further including a plurality of tappets for operating respective of said poppet vales and slidably supported in the bores of said cam shaft bearing member associated with the coil compression spring for the respective poppet valve.

* * * * *

UNITED STATES PATENT AND TRADEMARK OFFICE

CERTIFICATE OF CORRECTION

PATENT NO. : 5,704,330
DATED : January 6, 1998
INVENTOR(S) : Tsuchida

It is certified that error appears in the above-identified patent and that said Letters Patent is hereby corrected as shown below:

Column 9,
Line 52, please change “said chin shaft” to -- said cam shaft --.

Column 10,
Line 63, please change “third popper” to -- third poppet --.

Signed and Sealed this

Twelfth Day of November, 2002

*Attest:*

*Attesting Officer*

JAMES E. ROGAN
*Director of the United States Patent and Trademark Office*